US006742951B2

(12) United States Patent
Schultz et al.

(10) Patent No.: US 6,742,951 B2
(45) Date of Patent: Jun. 1, 2004

(54) CLEANING IMPLEMENT

(75) Inventors: Marissa A. Schultz, Caledonia, WI (US); Heath A. Doty, Richmond Heights, MO (US); Marc W. Hunter, Clayton, MO (US); Keith H. Gausmann, Austin, TX (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/200,864

(22) Filed: Jul. 23, 2002

(65) Prior Publication Data

US 2004/0018038 A1 Jan. 29, 2004

(51) Int. Cl.[7] ..... A47L 1/08

(52) U.S. Cl. ..... 401/139; 401/137; 401/190; 401/261; 401/263; 401/266

(58) Field of Search ..... 401/139, 137, 401/190, 261, 263, 266

(56) References Cited

U.S. PATENT DOCUMENTS

| | | | | |
|---|---|---|---|---|
| 2,312,108 | A | 2/1943 | Mead | |
| 4,778,301 | A | 10/1988 | Sicotte | |
| 4,954,001 | A | 9/1990 | Billat | |
| 5,007,753 | A | 4/1991 | England, Jr. | |
| 5,165,811 | A | 11/1992 | MacLeod | |
| 5,299,876 | A | 4/1994 | Singarella | |
| 5,333,347 | A | 8/1994 | Stranders | |
| 5,410,771 | A | 5/1995 | Bereza | |
| 5,862,562 | A | 1/1999 | Erken | |
| 5,885,019 | A | 3/1999 | Stear | |
| 5,988,912 | A | 11/1999 | Chen | |
| 6,006,393 | A | 12/1999 | Lynch et al. | |
| 6,223,380 | B1 * | 5/2001 | Klima et al. | 401/139 X |

* cited by examiner

*Primary Examiner*—Gregory L. Huson
*Assistant Examiner*—Kathleen J. Prunner

(57) ABSTRACT

A cleaning implement provides a spray head for a cleanser spray bottle. It also mounts on its forehead a removable cleaning pad. The spray head threads onto a conventional spray bottle. The cleaning pad is mounted immediately above the spray outlet. It has a slot to engage the spray head. There can be a living hinge to allow the pad to flex, and the forehead can be rounded to permit the pad to rotate on the spray head without being removed to change orientations. A single hand can be used to spray and rub a hard surface, without the need for a spray bottle to be put down while wiping the surface.

12 Claims, 4 Drawing Sheets

CLEANING IMPLEMENT

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to cleaning implements, and in particular to a sprayer device having an attached cleaning pad.

Common household and automotive surfaces, such as windows and counter tops, are often cleaned by spraying a cleaning chemical on them and then wiping the surface with a cloth, sponge, towel or the like. More stubborn stains may require scrubbing with an abrasive pad. In any event, these accessories are typically not attached to the spray bottle. They must be either carried in a different hand or in a different manner from the spray bottle. Sometimes they are set down while the spray bottle is being used, with the resulting problem of contamination of the surface that the accessory is placed on, or the dirtying of the accessory (e.g. if it placed on the ground outside).

There have been some attempts to link a cleaning pad with a spray bottle. For example, U.S. Pat. No. 5,885,019 discloses a scrubber attachment for an ordinary trigger-operated spray bottle. This design is disadvantageous, however, because the attachment connects to the spray nozzle and thus needs to be removed to adjust the spray pattern. Also, the attachment is susceptible to turning or loosening as it is used, which can cause it to separate from the bottle inadvertently or to change the adjustment of the spray nozzle. Moreover, the position and essentially vertical angle of the attachment requires it to be held in an unnatural vertical position when scrubbing, which can lead to hand and wrist fatigue and/or decrease the effectiveness of the scrubbing action.

U.S. Pat. No. 5,299,876 discloses a surface cleaning device using a pump-action spray bottle. This design is disadvantageous, however, because it is difficult to grip without touching the cleaning elements and it does not provide a scrubbing surface.

Accordingly, there exists a need in the art for an improved cleaning implement having a spray bottle linked to a cleaning pad in a more useful manner.

SUMMARY OF THE INVENTION

The invention provides a cleaning implement. There is a spray head suitable to be attached to a bottle, the spray head having a lower inlet and a side outlet, the spray head also having a forehead positioned above and separated from the side outlet. There is also a cleaning pad removably mounted on the forehead.

As used herein the term "pad" is intended to mean any accessory suitable to wipe a hard surface during cleaning. This includes, without limitation, sponges, brushes, cloths mounted on slab structures, abrasive pads, and the like.

In preferred forms a longitudinal axis of the cleaning pad is mounted at an angle relative to a longitudinal axis of the spray head, there is a tongue and groove connection between the forehead and the cleaning pad, and the pad has a groove which is rearwardly open and open at at least one end. This helps reduce arm strain during use, keeps the pad from interfering with the spray while allowing use of large pads, and allows easy installation of the pads.

In other forms there is a living hinge permitting the pad to flex relative to the spray head inlet. For example, the forehead can be linked to the spray head inlet with a living hinge. Alternatively, the pad can be linked by a living hinge to a receptor that receives the forehead.

If desired, the forehead can be a generally rectangular plate with contoured corners. This allows the pad to be rotated on the forehead without removal, as would be desirable for wiping differently shaped objects.

In still other forms the pad is a scrubbing sponge that acts both as an abrasive and as an absorptive material. When a spray bottle is linked to the inlet of the spray head, the unit will permit spraying of the hard surface, followed by wiping of the surface with the pad with a slight tilt of the wrist.

In another aspect the invention provides methods of cleaning hard surfaces using the above implements.

Thus, the present invention provides an improved tool and methods for cleaning windows, counters and other hard surfaces. The cleaning implement provides a spray bottle for spraying liquid cleanser on the surface and also a pad attachment that can be used to scrub, wipe or dry the surface before or after the cleanser is sprayed thereon. Importantly, the pad can be used without changing one's grip on the sprayer.

Hand and wrist strain is minimized due to the inclined mounting angle of the attachment and the flexing allowed by the living hinge. The mounting arrangement allows the attachment to be separated from the sprayer for cleaning, replacement or to exchange the pad or the entire attachment to change function of the attachment. In one form, the mounting arrangement permits the attachment to be rotated without being removed from the spray head to change the orientation of the attachment to and from vertical and horizontal and thereby narrow or widen the effective width of the attachment, given the rectangular configuration of the attachment.

These and other advantages of the invention will be apparent from the detailed description and drawings.

DETAILED DESCRIPTION OF THE PREFERRED EMBODIMENTS

Figure 1:
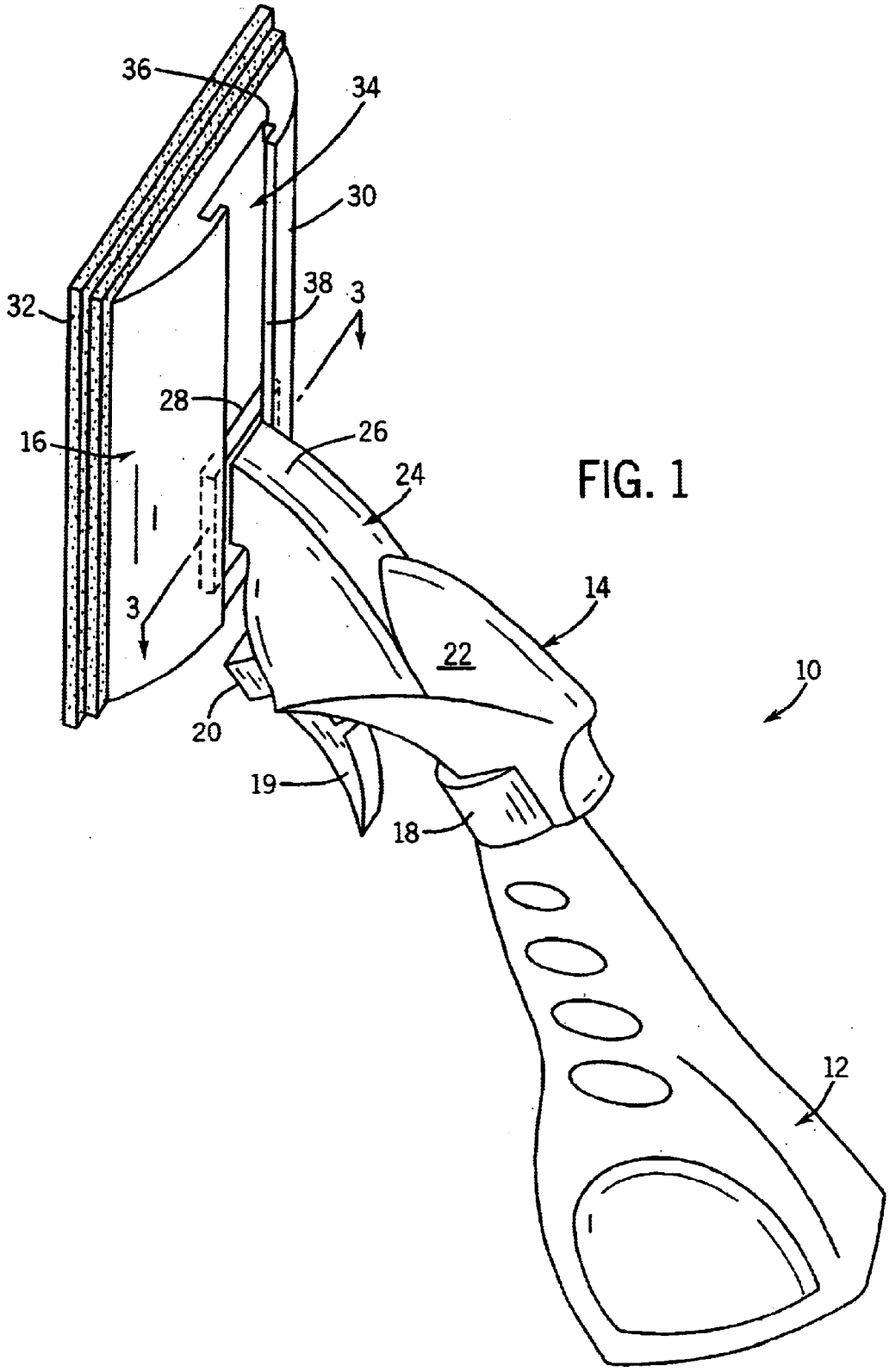
FIG. 1 is a rear perspective view of the cleaning implement of the present invention.
Figure 2:
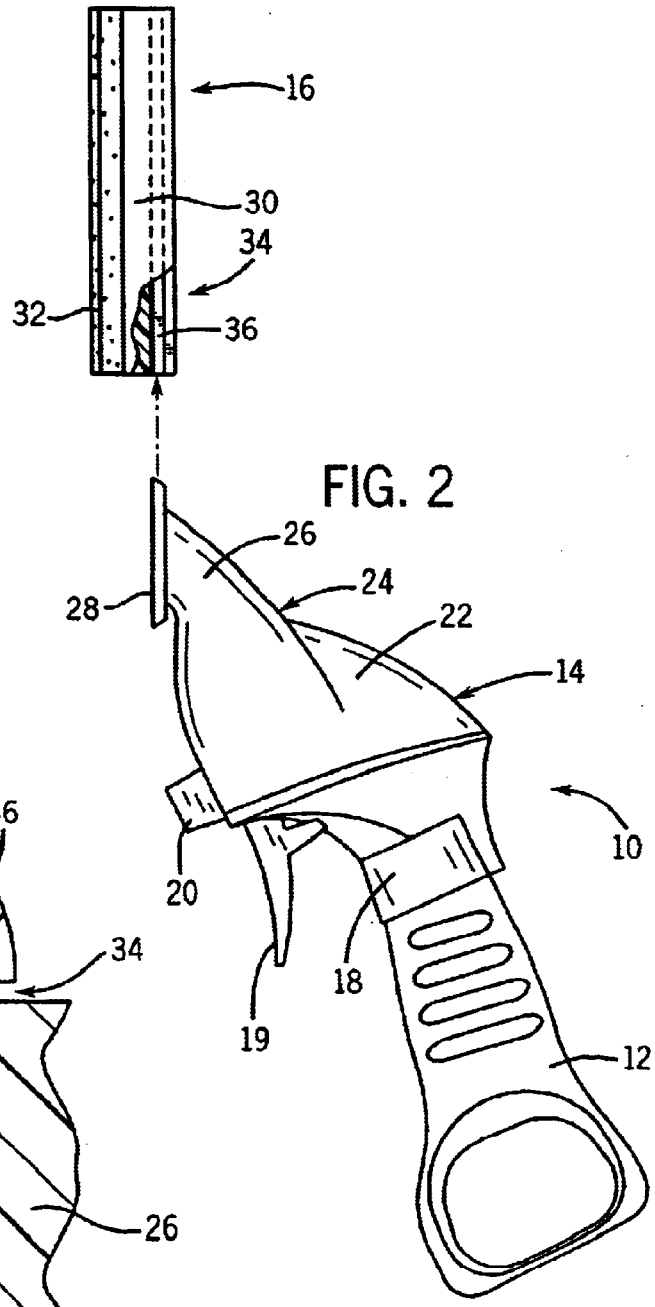
FIG. 2 is a side view thereof with a cleaner attachment shown separated from a spray bottle.
Figure 3:
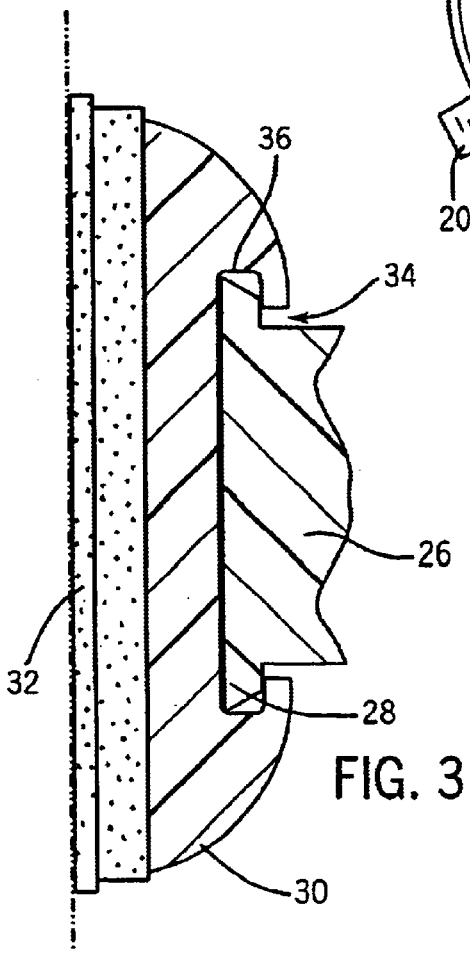
FIG. 3 is a cross-sectional view taken along line 3—3 of FIG. 1.

Referring to FIGS. 1–3, the cleaning implement 10 of the present invention includes three primary components, namely, a spray bottle 12 on to which is threaded a spray head 14 having a forehead 28. The spray head mounts a pad assembly 16. The spray bottle 12 can be a conventional bottle containing a conventional cleaner and having a standard sized mouth external threads. An example would be a Windex® spray bottle.

The spray head 14 is similar to conventional spray heads having an inlet opening surrounded by a rotatable, internally threaded collar 18 that can engage the threads of the bottle mouth to secure the spray head to the bottle (e.g., those currently used with Windex® spray bottles). The spray head similarly has a conventional trigger assembly 19 that controls flow through a tube disposed in the bottle and extending through the inlet opening of the spray head to an outlet opening at which is mounted a spray nozzle 20. As is conventional, the spray nozzle can be turned to close off spray and to vary the spray pattern, such as from a narrow stream to a wide mist spray.

The spray head 14 first differs from conventional spray heads in the shape of the contoured surface 22 at the top side of the spray head and, more importantly, in the mounting member 24 formed integrally with the spray head at its top side. The mounting member defines a neck section 26 extending upwardly to an attachment forehead 28 at its upper end that is shown as a generally rectilinear, planar structure of larger dimension than the neck 26. The forehead 28 is angled back from vertical approximately 20 degrees (considering the respective longitudinal axes of the forehead and spray unit). Preferably, the perimeter of the forehead tapers outwardly at its edges for easing the mounting of the cleaner attachment.

The pad 16 has a generally rectangular, rigid plastic backing plate 30 having a front face to which a scrubbing element 32 is attached. The back side of the plate is formed with a slot 34 running through the length of the plate and opening at the back side and at opposite ends. The slot defines a channel 36 sized to tightly accommodate the platform of the spray head and a back side opening 38 of lesser width than the channel but large enough to accommodate the neck of the mounting member so that the platform is captured in the slot.

The pad thus is mounted to the spray head by sliding it onto the forehead from one end. The height of the pad relative to the spray unit can be adjusted by sliding it up or down, and it can be removed by sliding it up or down far enough so that the platform passes through one end.

Figure 7:
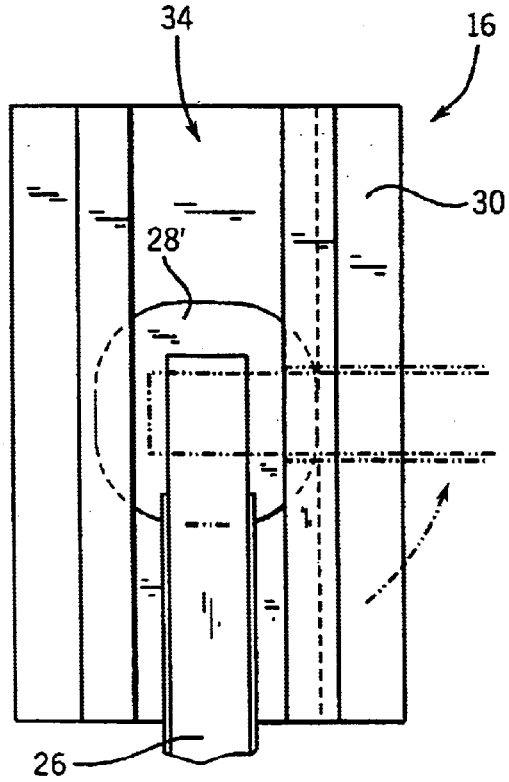
FIG. 7 is a rear view of another embodiment of the forehead allowing the pad to rotate between vertical and horizontal orientations without removing the cleaner attachment from the spray head.

In another preferred form shown in FIG. 7, the platform 28' is approximately square but has rounded corners. This allows the pad 16 to be turned in either direction to change its mounting orientation from vertical (aligned with the spray bottle) to horizontal (perpendicular to the spray bottle).

In the case where the attachment has an oblong shape, the attachment can be oriented to sweep a narrow (vertical) or wide (horizontal) path, thereby allowing the cleaning element to fit in smaller places or to clean a wider area with each stroke. The rounded corners reduce the contact of the platform with the inner walls of the channel as the attachment is being turned. However, the contacting surfaces, albeit reduced, resist turning so that the attachment does not rotate inadvertently during use.

The cleaning element can be any suitable device to wipe, dry or scrub the surface of the object being cleaned. In the form illustrated in the drawings, the cleaning element is a scrubbing pad. However, it could also be a sponge, cloth or towelette. Preferably, the cleaning element will have an absorbent surface to absorb cleanser sprayed from the spray bottle.

The element could also include a scraper plate of metal or plastic and a rubber wiper feature to provide a squeegee for cleaning windows. The cleaning element can be attached to the backing plate in any suitable manner, such as using a mechanical fastener or an adhesive. The cleaning element can be attached permanently or such that it can be removed and reattached after being cleaned or replaced by another cleaning element of the same or a different type.

The cleaning implement could also be formed with a hinge to permit the cleaner attachment to flex or pivot with respect to the spray head so the face of the cleaning element can change angles as the sprayer is moved during cleaning. This helps keep more of the cleaning element on the surface being cleaned throughout the range of movement and also reduces strain on the users hand and wrist. The pivot generally reduces fatigue and further obviates the need to change one's grip on the spray head. A preferred range of motion for the hinge is 30 degrees, 15 degrees in each up and down direction from its resting position, which is preferably tipped back 20 degrees from vertical.

Figure 4:
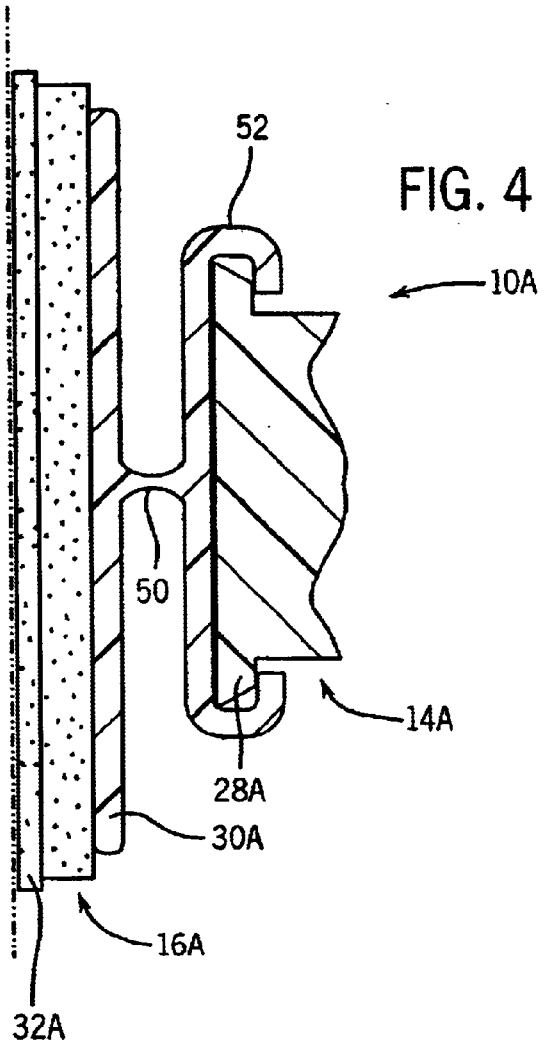
FIGS. 4 and 5 show in cross-section alternate embodiments of the cleaner attachment incorporating living hinge features.
Figure 5:
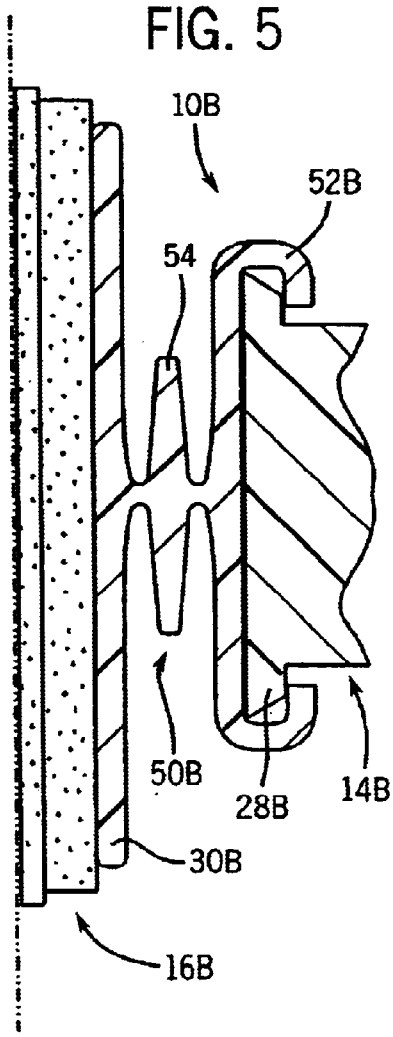
Figure 6:
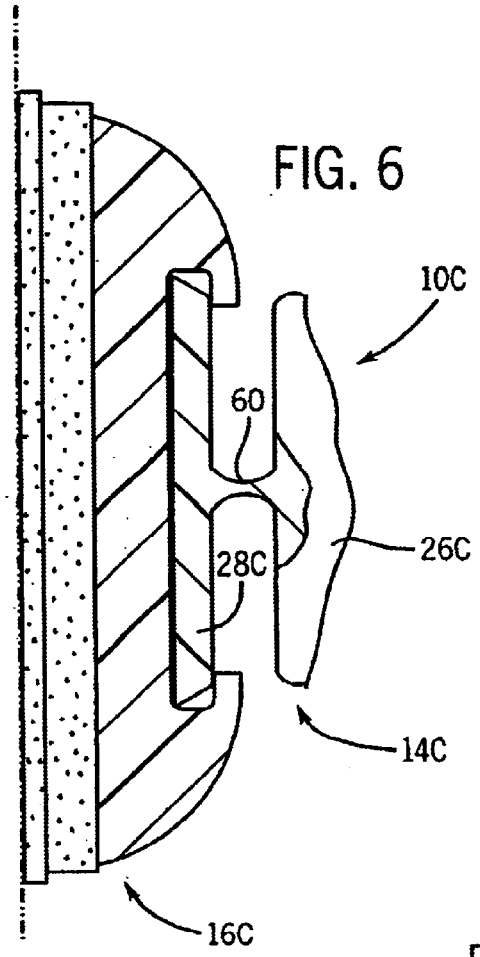
FIG. 6 shows in cross-section an alternate embodiment of the spray head forehead incorporating a living hinge.

FIGS. 4 and 5 show two embodiments in which the cleaning attachment includes a plastic hinge allowing it to pivot or flex back and forth generally horizontally about the neck of the spray head mounting member. FIG. 6 show another embodiment providing similar flexing as the embodiments of FIGS. 4 and 5, however, in which the hinge is part of the spray head mounting member. These embodiments will be described briefly below with the elements similar to that of the first described embodiment being referred to using similar reference numbers albeit with the suffices "A", "B" and "C", respectively.

Referring to FIG. 4, the cleaning implement 10A includes a spray bottle (not shown) and a spray head 14A identical to that described above. A cleaner attachment 16A has a rigid backing plate 30A having a front face to which a cleaning element 32A is attached. The back side of the backing plate defines a hinge 50 joining a C-shaped channel 52. The channel is open at opposite ends and along its back side so to capture the platform 28A of the spray head and connect the cleaner attachment to the spray head in a slide-on tongue and groove connection.

The hinge is a thin section narrowing inwardly from its ends molded integrally with the attachment. The narrow dimension permits the hinge to flex along its length when the attachment is stressed by forces acting on the cleaning element and thus allows the backing plate (and thereby the cleaning element) to pivot clockwise or counter-clockwise about the length of the hinge.

Referring to FIG. 5, the cleaning implement 10B includes a spray bottle (not shown) and a spray head 14B identical to that described above. A cleaner attachment 16B has a rigid backing plate 30B having a front face to which a cleaning element is attached. The back side of the backing plate defines a hinge 50B joining a C-shaped channel 52B. The channel is open at opposite ends and along its back side so to capture the platform 28B of the spray head and connect the cleaner attachment to the spray head in a tongue and groove connection.

The hinge 50B is a narrowed structure like above albeit here it includes a strengthening member 54 generally parallel to the backing plate running the length of the hinge at its center. This hinge thus defines two hinge points in each direction, one on each side of the strengthening member. Thus, the hinge can flex along its length to allow the backing plate (and thereby the cleaning element) to pivot clockwise or counter-clockwise about the length of the hinge.

Referring now to FIG. 6, the cleaning implement 10C includes a spray bottle (not shown) and a cleaner attachment 16C identical to the first described embodiment. A spray head 14C is similar to the above described spray head, but there is a hinge 60 formed between the upper end of an upwardly extending neck section 26C and an attachment platform 28C. The hinge 60 is a thin section narrowing inwardly from its ends permitting it to flex along its length when the attachment is stressed. As before, the platform is angled back from vertical approximately 20 degrees to provide a comfortable angle when cleaning.

Thus, the present invention provides a new and improved tool for cleaning windows, mirrors, counters and other soiled surfaces. The cleaning implement provides in one handy device a spray bottle for spraying liquid cleanser on the surface and a pad attachment that can be used to scrub, wipe or dry the surface before or after the cleanser is sprayed thereon. The pad can be used without changing one's grip on the sprayer.

Hand and wrist strain is minimized due to the mounting angle of the attachment and the flexing allowed by the living hinge. The mounting arrangement allows the attachment to be separated from the sprayer for cleaning, replacement or to exchange the pad or the entire attachment to change function of the attachment. In one form, the mounting arrangement permits the attachment to be rotated without being removed from the spray head to change the orientation of the attachment to and from vertical and horizontal and thereby narrow or widen the effective width of the attachment, given the rectangular configuration of the attachment.

Preferred embodiments of the invention have been described in considerable detail. Modifications and variations to the preferred embodiments will be apparent to those skilled in the art, which will be within the spirit and scope of the invention. Therefore, the invention should not be limited to the described embodiments. To ascertain the full scope of the invention, reference should be made to the following claims.

INDUSTRIAL APPLICABILITY

The invention provides an improved cleaning implement for spraying and wiping a surface.

We claim:

1. A cleaning implement comprising:

a spray head suitable to be attached to a bottle, the spray head having a lower collar suitable to engage said bottle and a side spray nozzle, the spray head also having a forehead positioned above and separately from the side spray nozzle; and a cleaning pad removably mounted on the forehead;

wherein the height of the cleaning pad relative to the forehead can be adjusted by sliding the cleaning pad on the forehead while the cleaning pad and forehead are joined together; and wherein the forehead is in the form of a plate having contoured corners, whereby the cleaning pad can be rotated on the forehead without removing the cleaning pad from the forehead.

2. The cleaning implement of claim 1, wherein a longitudinal axis of the cleaning pad is mounted at an angle relative to a longitudinal axis of the spray head.

3. The cleaning implement of claim 1, wherein there is a tongue and channel connection between the forehead and the cleaning pad.

4. The cleaning implement of claim 3, wherein the pad has a slot which is rearwardly open and open at at least one end.

5. The cleaning implement of claim 1, wherein there is a living hinge permitting the pad to flex relative to the spray head.

6. The cleaning implement of claim 5, wherein the forehead is linked to the spray head with a living hinge.

7. The cleaning implement of claim 5, wherein the pad is linked by a living hinge to a channel.

8. The cleaning implement of claim 1, wherein the forehead is a generally rectangular plate.

9. The cleaning implement of claim 1, wherein the pad is a scrubbing pad.

10. The cleaning implement of claim 1, wherein the pad is a sponge.

11. The cleaning implement of claim 1, wherein the spray bottle is linked to the collar of the spray head.

12. A method of cleaning a hard surface, comprising:

spraying the hard surface with a cleaning composition using a cleaning implement, the cleaning implement comprising:

a spray bottle having the cleaning composition therein;

a spray head attached to the bottle, the spray head having a lower collar engaging the bottle and a side spray nozzle, the spray head also having a forehead positioned above and separately from the side spray nozzle; and a cleaning pad removably mounted on the forehead;

wherein the height of the cleaning pad relative to the forehead can be adjusted by sliding the cleaning pad on the forehead while the cleaning pad and forehead are joined together; and wherein the forehead is in the form of a plate having contoured corners, whereby the cleaning pad can be rotated on the forehead without removing the cleaning pad from the forehead; and then rubbing the surface with the pad.

* * * * *